US009222686B2

(12) United States Patent
Al-Qassem

(10) Patent No.: US 9,222,686 B2
(45) Date of Patent: Dec. 29, 2015

(54) APPARATUS FOR REMOVING WATER VAPOR FROM AN ENCLOSURE

(76) Inventor: Sadeq Ahmed Al-Qassem, Adan (KW)

( * ) Notice: Subject to any disclaimer, the term of this patent is extended or adjusted under 35 U.S.C. 154(b) by 1808 days.

(21) Appl. No.: 12/019,065

(22) Filed: Jan. 24, 2008

(65) Prior Publication Data

US 2009/0188984 A1 Jul. 30, 2009

(51) Int. Cl.
*F24F 3/14* (2006.01)
*F24F 11/00* (2006.01)
*F24F 7/00* (2006.01)

(52) U.S. Cl.
CPC ..... *F24F 3/14* (2013.01); *F24F 2003/144* (2013.01)

(58) Field of Classification Search
USPC ..... 236/44 R, 44 A–44 C, 44 E, 49.1; 62/176.1; 307/118, 39; 73/29.02, 73/335.05, 335.06; 318/341, 318; 165/282, 283, 284; 261/129
See application file for complete search history.

(56) References Cited

U.S. PATENT DOCUMENTS 3,983,527 A * 9/1976 Ohsato et al. ..... 338/35
4,052,691 A * 10/1977 Nagano et al. ..... 338/35
4,350,286 A * 9/1982 Sutoh et al. ..... 236/44 A
4,383,574 A * 5/1983 Yoshioka ..... 165/43
4,622,500 A * 11/1986 Budelman, Jr. ..... 388/811
4,953,784 A * 9/1990 Yasufuku et al. ..... 236/44 A
5,102,042 A * 4/1992 Hart ..... 236/78 R
5,578,753 A * 11/1996 Weiss et al. ..... 73/335.02
5,724,298 A * 3/1998 Henry ..... 365/229
6,935,570 B2 * 8/2005 Acker, Jr. ..... 236/44 R

* cited by examiner

*Primary Examiner* — Khoa Huynh
*Assistant Examiner* — Timothy K Trieu
(74) *Attorney, Agent, or Firm* — Hauptman Ham, LLP

(57) ABSTRACT

An apparatus for removing humidity from an enclosure includes a first resistor, a second resistor, a diode, a transistor, a battery, a first electrode and a second electrode, a relay coil, a first electric generator, a second electric generator, a dehumidifier, a direct circuit for operating the dehumidifier manually. The first electrode and second electrode are arranged on a base. The base is an insulator (non-conductive) and hence the electrodes are not connected by the base. The arrangement of the electrodes is such that the first electrode is spaced apart from the second electrode at a distance, preferably, less that 3 mm. The distance of less than 3 mm enables the water droplets to be collected between the two electrodes thereby connecting the first electrode to the second electrode.

3 Claims, 3 Drawing Sheets

APPARATUS FOR REMOVING WATER VAPOR FROM AN ENCLOSURE

FIELD OF THE INVENTION

This invention relates to an approach for removing water vapor from an enclosed room and more particularly to an apparatus for removing water vapor from a bathroom or the like.

BACKGROUND OF THE INVENTION

It is well known that when an individual runs hot water for an extended time, a bathroom becomes filled with water vapor. This vapor condenses on walls, ceilings and mirrors so that a person cannot easily use the mirror for grooming. Also, the vapor accumulated on the ceilings, mirrors and walls leaves stains, thereby giving an undesirable look to the bathroom.

For many individuals, the excessive moisture in the air is a nuisance. However, the problem for individuals with pulmonary or respiratory illnesses such as asthma and emphysema is far more serious. Such individuals frequently have problems breathing and inhaling sufficient oxygen to meet their needs. Such problems are exacerbated during periods of high humidity, particularly during times of bathing.

Therefore, it is often desirable to reduce the humidity in a bathroom and at the same time to allow individuals with pulmonary and respiratory problems to enjoy a leisurely bath without sacrificing their health or putting them in jeopardy.

One common approach for reducing water vapor in bathrooms is to use an exhaust fan. Such fans exhaust the moisture from the room and replace it with dryer air from an adjacent area. However, it is sometimes necessary to replace most of the air and in many cases the replaced air is relatively cold.

One attempt to overcome the problem of replacing warm humid air with cold dry air is disclosed in a U.S. Pat. No. 5,884,694 of Tanenbaum. As disclosed therein a dehumidifier for use in a bathroom utilizes the cold surface of a heat exchanger to condense moisture and the hot surface of the heat exchanger to warm the air after the moisture is removed. The cold surface is provided by having the cold water supplied to the room pass through the cold heat exchanger and the hot surface is provided by having a hot water supply to the room pass through the hot heat exchanger. The heat exchangers may be concentric circles or may be rectangular with a plenum at each end so air moves across the two. A drip pan beneath the cold heat exchanger catches the condensate. Also, an exhaust fan may be mounted concentrically with the recirculation fan in the circular heat exchanger or may be mounted in the output plenum of a rectangular device.

A more recent approach to dehumidifying air in a bathroom is disclosed in a second U.S. patent of Tanenbaum, U.S. Pat. No. 6,168,086. As disclosed therein, a dehumidifier comprises hot and cold water supply pipes interconnected to a shower head in a bathroom. A hot heat exchanger in interconnected to the hot water supply pipe, fan means pulls air from an adjacent room across the hot air exchanger into the bathroom and an exhaust fan removes air from the bathroom. In this disclosure dehumidification is accomplished by the use of a dehumidifier or refrigeration system wherein the evaporator acts as a cold surface on which moisture condenses and the condenser acts as a heat exchanger to re-warm the air before it passes back into the room.

Notwithstanding the above, it is presently believed that there is a need for and a potential commercial market for an apparatus for removing water vapor from a bathroom in accordance with the present invention. There should be a market for such apparatus because it is particularly suitable for persons with pulmonary and respiratory problems. Further, the apparatus in accordance with the present invention automatically starts to remove the warm humid air from the room when the humidity reaches a pre-selected level and at the same time includes a manual override for reducing the humidity in the room at anytime selected by an individual using the bathroom. Further, it is believed that the apparatus in accordance with the present invention is relatively simple in design, can be manufactured and installed at a competitive price, is reliable and durable and can be readily serviced and turned on and off at the will of an individual irrespective of a level of humidity in the room. For example, if the bathroom is being used by a healthy individual that desires a warm humid environment the individual can easily bypass the automatic action.

BRIEF SUMMARY OF THE INVENTION

In essence, the present invention contemplates an apparatus for removing water vapor from an enclosure such as a bathroom and the like when individual draw relatively large volumes of hot water. The apparatus includes a source of electrical energy such as a cord and plug for connection to a conventional wall receptacle for connection to a 110/220 volt source of electricity. The apparatus also includes water removing means as for example an exhaust fan for removing the humid air from the room or possibly a dehumidifier and humidity actuated switch for turning the exhaust fan or other means for reducing the humidity on. An important feature of the present invention resides in the humidity activated switch that includes a non-conductive base and a pair of adjacent electrodes disposed on or fixed to the non-conductive base. In a preferred embodiment of the invention, the electrodes define a pair of elongated bare copper wires that are spaced apart by about 3 mm or less. One of the electrodes is in electrical contact with the source of electrical energy while the other element is connected to a relatively larger exhaust fan or other means for reducing the water vapor in the room. As the humidity in the room increases water vapor and/or droplets form on the electrodes and bridge the gap to complete an electrical circuit to actuate the exhaust fan, dehumidifier or the like. The invention also contemplates the use of a separate manually operable three-way switch to turn the water removing means on or off.

DESCRIPTION OF THE PREFERRED EMBODIMENTS OF THE INVENTION

Figure 1:
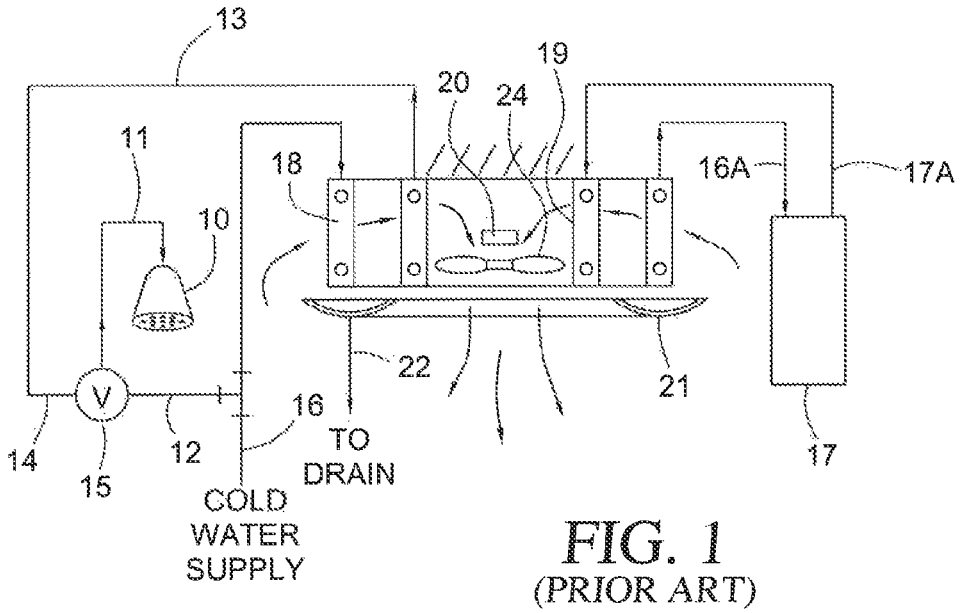
FIG. 1 (PRIOR ART)
FIG. 1 is a schematic illustration showing a prior art dehumidifying system.

FIG. 1 is a schematic diagram that illustrates a prior art dehumidifying system for a bathroom or the like. As shown, the bathroom includes a shower represented by a shower head 10. The shower head 10 is supplied with water through a pipe 11 that is connected to a cold water line 12 and a hot water line 14. A conventional valve 15 is included to control the mix of cold and hot water flow in a conventional manner. The hot water line 12 is fed from the cold water supply 16. The supply 16 is connected to a heat exchanger 18 and is fed into a water heater 17 at 16*a*. The water in the heater 17 is raised to the desired "hot" temperature and leaves the water 17 at 17*a* and enters a heat exchanger 19. From the heat exchanger 19 the water passes through the hot water supply pipe 13 to the line 14 and to the shower head 10. A dehumidifier 20 includes the cold heat exchanger 18 which has an annular drip pan 31 under it and a drain line 22 that leads to a drain (not shown). There is also the heat exchanger 19 inwardly of the exchanger 18 and centrally of 19 and a fan 24 to move air through the apparatus. As shown in FIG. 1, the fan 24 discharges air down into the room via the humidifier. The suction side of the fan 24 then pulls air from the room and over the coils of the two heat exchangers.

Further details of the prior art device are disclosed in the U.S. Pat. No. 5,884,694 which is incorporated herein in its entirety by reference.

Figure 2:
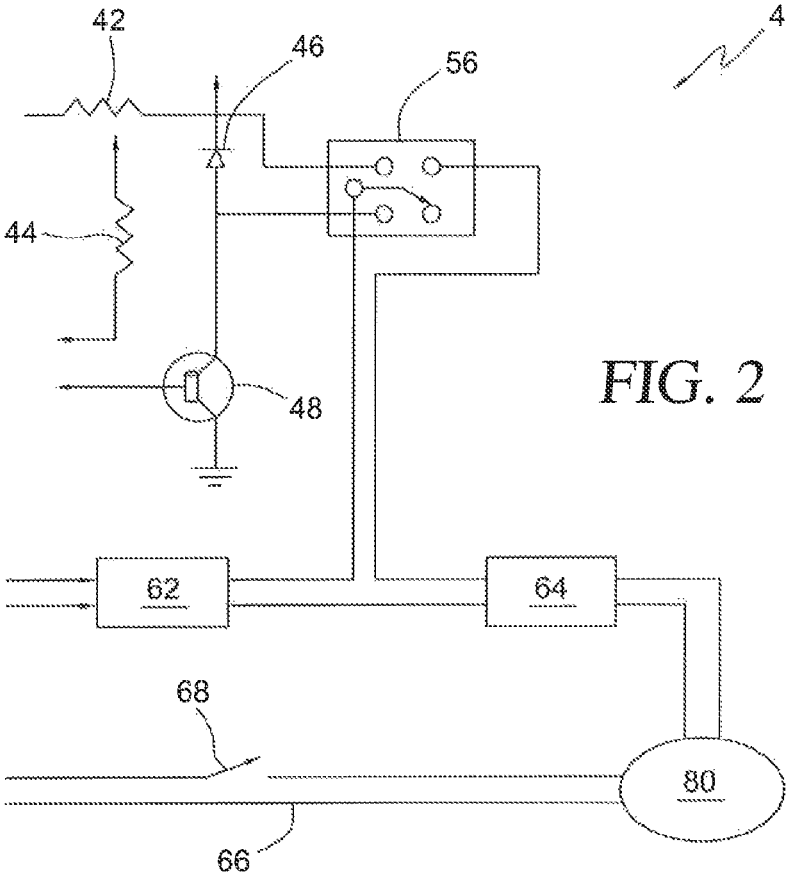
FIG. 2 is a circuit diagram according to one embodiment of the present invention.

Now referring to FIG. 2, there is shown an electrical circuit 4 used in an apparatus for removing water vapor from an enclosure according to one embodiment of the present invention. The circuit 4 includes a first resistor 42, a second resistor 44, a diode 46, a transistor 48, and a battery (not shown). The circuit also includes a first electrode 50 and a second electrode 52 (shown in FIG. 4), a relay coil 56, a first electric generator 62, a second electric generator 64, a dehumidifier 80, a circuit 66 for manually activating a dehumidifier 80.

The first resistor 42 is preferably of 1 Mega Ohm and is used to divide the electrical voltage. The second resistor 44 is preferably 10 K Ohm and is used for its electrical resistance. The diode 46 is preferably of the type IN 4001 and is used to protect the transistor 48 by controlling the flow of the current there through. The two electrodes 50 and 52 are preferably copper wires. The circuit 66 also includes an electric switch 68 to manually activate the dehumidifier 80.

The first resistor 42 may be a variable resistor which divides the electrical voltage and is used to control the sensitivity of the humidity sensor. For example, if the variable resistor is set at a high level, the sensor will activate the dehumidifier because it will detect very small levels of the humidity in a chamber. The function of the 10 K Ohm resistor is to reduce or minimize the voltage for control by the variable resistor.

Figure 5:
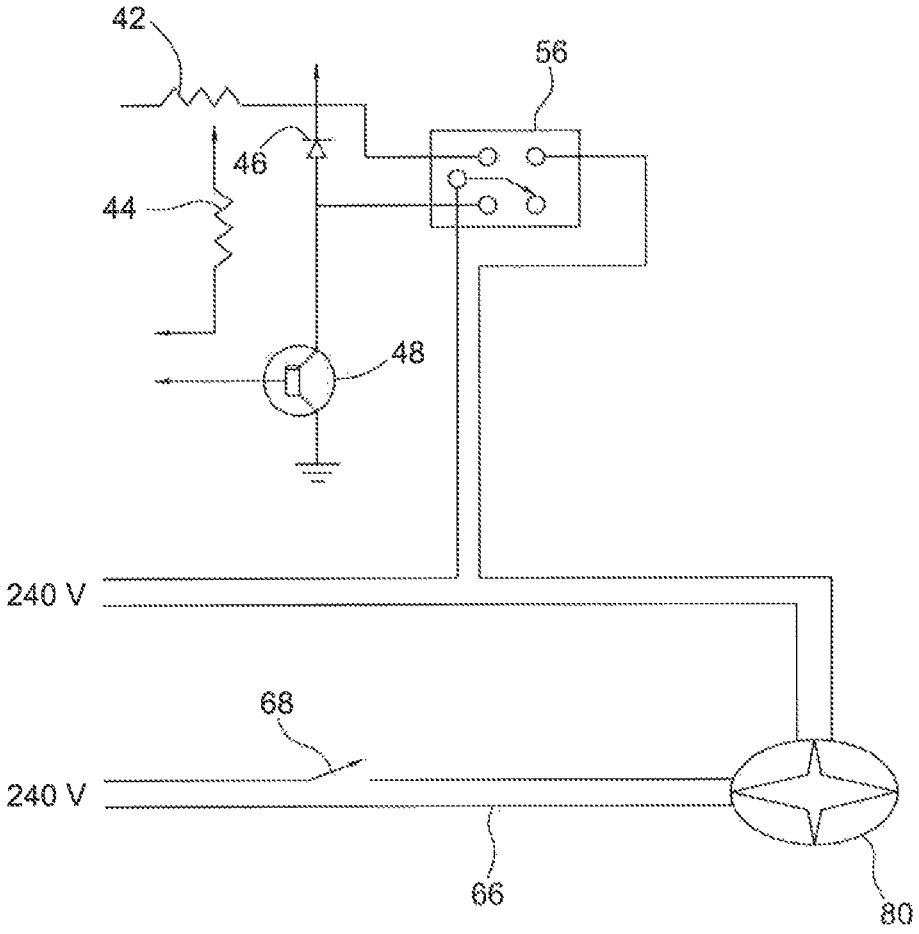
FIG. 5 is a circuit diagram according to a second embodiment of the invention.

Further, the first generator (transformer) 62 and second generator (transformer) 64 can be eliminated in a further embodiment of the invention as illustrated in FIG. 5 wherein like reference numerals have been used to designate like parts.

Figure 4:
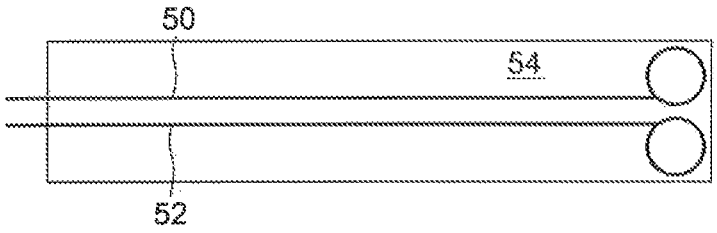
FIG. 4 is a schematic illustration of a relay coil used in the circuit of the present invention.

As shown in FIG. 4, the first electrode 50 and second electrode 52 are used to complete the circuit 4. The electrodes 50 and 52 are arranged on a base 54. The base 54 is an insulator and hence the electrodes 50 and 52 are not electrically connected by the base 54. The arrangement of the electrodes 50 and 52 is such that the first electrode 50 is spaced apart from the second electrode 52 at a distance, preferably, less than 3 mm. This distance of less than 3 min enables the water droplets to be collected between the two electrodes 50 and 52 thereby connecting the first electrode 50 to the second electrode 52.

The first electrode 50 is electrically connected to a source of electrical energy while the second electrode 52 is connected to the dehumidifier 80 for reducing the water vapor in the room.

Figure 3:
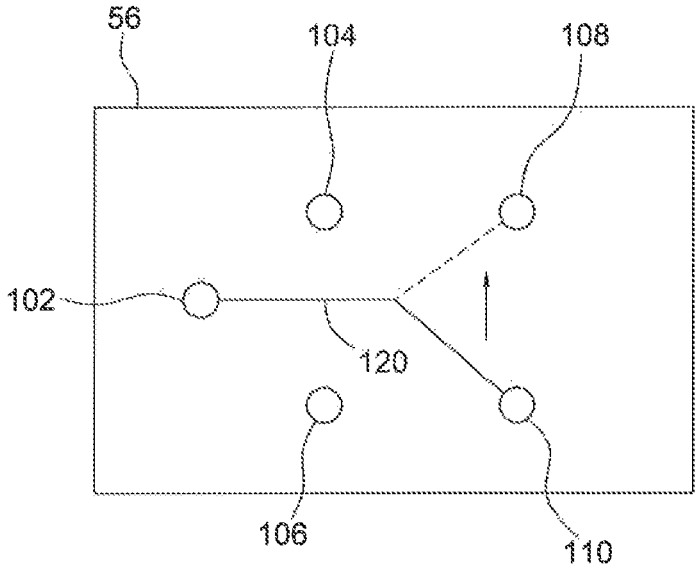
FIG. 3 is a schematic illustration of the electrodes used to complete the circuit in accordance with the present invention.

Now referring to FIG. 3, a relay coil 56 is used in the circuit 4 of the present invention. The relay coil 56 includes a plurality of magnetic coils 102, 104, 106, 108, and 110 and a metal tape 120. When the circuit 4 is in an open position, i.e., when the electrodes 50 and 52 are not connected by the water droplets, the metal tape 120 is attracted towards the magnetic coil 110. Further, when the circuit 4 is in a closed position, i.e., when the electrodes 50 and 52 are connected by the water droplets, the metal tape 120 is attracted towards the magnetic coil 108.

In the operation of the invention, when the humidity in the bathroom (enclosure) increases, the water droplets accumulates in between a first electrode 50 and a second electrode 52. The connection of the first electrode 50 with the second electrode 52 in turn causes the circuit 4 to close. Therefore, an electric current is passed through the relay 56. Thus, the magnetic coil 108 inside the relay coil 56 will be magnetized and as a result, the metal tape 120 is attracted towards the magnetic coil 108. Therefore, the electric current is passed to operate the dehumidifier 80. Thereafter, when the excess amount of humidity is reduced the dehumidifier is opened and current is stopped.

Further, if the individual, using the bathroom desires a certain amount of humidity, a circuit 66 may be used. It should be noted that, while operating the circuit 66, the circuit 4 is in an open position, i.e. the electrodes 50 and 52 are not connected and the metal tape 120 is located near the magnetic coil 110. A manual switch 68 is closed, thereby allowing an electric current to pass through the circuit 66. Therefore, the dehumidifier 80 operates to remove the humidity. Thereafter, when the required amount of humidity is removed from the bathroom, the manual switch may be opened so that the passage of the electric current is stopped.

While the invention has been disclosed in connection with its preferred embodiments it should be recognized that changes and modifications may be made therein without departing from the scope of the claims.

What is claimed is:

1. An apparatus for removing water vapor from an enclosure comprising:

a source of electrical energy, a dehumidifier for removing water vapor from a mixture of air and water and an electrical circuit including a first variable resistor for controlling the sensitivity of a humidity sensor and a second resistor for controlling and reducing the voltage for control by said variable resistor, a transistor and an IN4001 diode for protecting said transistor by controlling the flow of current therethrough and a non-conductive base and first and second spaced apart parallel uninsulated copper electrodes spaced apart at a distance of less than 3 mm;

said dehumidifier and said first electrode electrically connected to said source of electricity and said second electrode connected to said dehumidifier so that water vapor or water droplets from the water vapor bridge a gap between said electrodes to thereby actuate said dehumidifier and a manually three-way activatable switch to directly connect and disconnect said dehumidifier and said source of electrical energy;

a relay coil including a plurality of magnetic coils and a metal tape so that when said electrodes are not connected by water vapor or water droplets said metal tape is attracted toward a first magnetic coil and when the electrodes are connected by the water vapor or water droplets, said metal tape is attracted toward a second magnetic coil causing an electric circuit to close so that electric current passes through the relay coil whereby said second magnetic coil inside said relay coil is magnetized to thereby attract said tape towards said second magnetic coil so that electric current is passed to operate said dehumidifier.

2. An electronic circuit for controlling the operation of a dehumidifier for removing water vapor from an enclosure comprising:

a first variable resistor for controlling the sensitivity of a humidity sensor; a second resistor for controlling and reducing the voltage for control by said variable resistor; a battery; first electric generator, and second electric generator; a transistor and an IN4001 diode for protecting said transistor by controlling the flow of current therethrough and a non-conductive base; first and second spaced apart parallel uninsulated copper electrodes spaced apart at distance of less than 3 mm; a source of electrical energy; a dehumidifier for removing water from a mixture of air and water; and a relay coil;

wherein the said dehumidifier and said first electrode electrically connected to said source of electricity and said second electrode connected to said dehumidifier so that water vapor or water droplets from the water vapor bridge a gap between said electrodes to thereby actuate said dehumidifier and manually three way activatable switch to directly connect and disconnect said dehumidifier and said source of electrical energy.

3. An electronic circuit for controlling the operation of a dehumidifier for removing water vapor from an enclosure according comprising:

a first variable resistor for controlling the sensitivity of a humidity sensor; a second resistor for controlling and reducing the voltage for control by said variable resistor; a battery; first electric generator, and second electric generator; a transistor and an IN4001 diode for protecting said transistor by controlling the flow of current therethrough and a non-conductive base; first and second spaced apart parallel uninsulated copper electrodes spaced apart at distance of less than 3 mm; a source of electrical energy; a dehumidifier for removing water from a mixture of air and water; and a relay coil;

wherein a relay coil including a plurality of magnetic coils and a metal tape so that when said electrodes are not connected by water vapor or water droplets said metal tape is attracted toward a first magnetic coil and when the electrodes are connected by the water vapor or water droplets, said metal tape is attracted toward a second magnetic coil causing an electric circuit to close so that electric current passes through the relay coil whereby said second magnetic coil inside relay coil is magnetized to thereby attract said tape toward said second magnetic coil so that electric current is passed to operate said dehumidifier.

* * * * *